US007581966B2

(12) United States Patent
Shigehisa et al.

(10) Patent No.: US 7,581,966 B2
(45) Date of Patent: Sep. 1, 2009

(54) MOUNTING STRUCTURE

(75) Inventors: Koji Shigehisa, Atsugi (JP); Toshitaka Tezuna, Atsugi (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/832,150

(22) Filed: Aug. 1, 2007

(65) Prior Publication Data

US 2008/0032548 A1 Feb. 7, 2008

(30) Foreign Application Priority Data

Aug. 1, 2006 (JP) ..... 2006-209935
Mar. 14, 2007 (JP) ..... 2007-065018

(51) Int. Cl.
*H01R 4/66* (2006.01)

(52) U.S. Cl. ..... 439/98

(58) Field of Classification Search ..... 439/516, 439/108, 730, 874, 98, 932, 399, 397, 394, 439/881, 582, 741, 287, 386, 284, 578, 92
See application file for complete search history.

(56) References Cited

U.S. PATENT DOCUMENTS 4,583,069 A * 4/1986 Pierce ..... 337/240
6,476,325 B2 * 11/2002 Kondo ..... 174/84 C
2005/0003703 A1 1/2005 Ono et al.
2007/0072455 A1 * 3/2007 Onuma et al. ..... 439/98

FOREIGN PATENT DOCUMENTS

JP 06-132041 A 5/1994
JP 2003-178824 A 6/2003
JP 2003-203687 A 7/2003
JP 2004040867 A * 2/2004

* cited by examiner

*Primary Examiner*—Edwin A. Leon
(74) *Attorney, Agent, or Firm*—Sughrue Mion, PLLC

(57) ABSTRACT

An electric wire is crimped by electric-wire crimping claws of a ground terminal. The electric wire is thermocompression-bonded to a thermocompression bonding surface of the ground terminal. The ground terminal is fixed to a vehicle body panel by a fastening force of a bolt and a nut and by an engaging force of a vehicle body fixing claw. The ground terminal is adapted so that each of the crimping force and a thermocompression bonding force is weaker than a fixing force. Consequently, in a case where the electric wire is peeled off in a direction perpendicular to the thermocompression bonding surface, the electric wire can easily be detached from the vehicle body panel without removing the bolt and the nut. Also, a vehicle body mounting hole is placed in the vicinity of the electric wire crimping claws and the thermocompression bonding surface, so that the moment of the ground terminal is reduced.

4 Claims, 15 Drawing Sheets

MOUNTING STRUCTURE

BACKGROUND OF THE INVENTION

1. Field of the Invention

The present invention relates to a mounting structure configured so that a ground terminal, to which an electric wire is crimped, is fixed to a vehicle body panel.

2. Related Art

In a conventional mounting structure of such a kind, a break groove (i.e., a fragile portion or a fracture portion) is formed in a joining terminal to enhance the disassemblability of an electric wire. Additionally, at the disassembly of a vehicle, the electric wire is removed from the vehicle body terminal, without removing fastening tools, such as a bolt and a nut, by dividing the connecting terminal in two along the fracture groove (see, e.g., JP-A-2003-178824 and JP-A-2003-203687).

However, this conventional mounting structure has the following problems.

First, because the formation of the break groove narrows an electric path, an electric resistance value of the electric path inevitably increases in inverse proportion to the cross-section area thereof.

Second, because a break force is determined mainly according to the depth of the break groove (i.e., the remaining thickness), factors of variations in manufacturing tend to be involved in the mounting structure in a case where the break force of the connecting terminal is set to be low. Consequently, it is difficult to apply the mounting structure to mass-produced goods.

Third, because paired electric wire crimp claws sandwiching an electric wire from both sides thereof are provided in parallel with each other in the connecting terminal, the crimping forces due to the electric wire crimping claws are superimposed, so that the peak value of the resultant crimping force increases. Consequently, difficulties are associated with the peeling of the electric wire from the connecting terminal.

SUMMARY OF THE INVENTION

An object of the invention is to provide a mounting structure capable of solving such problems.

To achieve the foregoing object, according to an aspect of the invention, there is provided a mounting structure (hereunder referred to as a first mounting structure of the invention) in which a connecting terminal is fixed to a mount member and in which a linear element is attached to the connecting terminal. The first mounting structure features that the connecting terminal has a mount member mounting hole and a thermocompression bonding surface, and that the mount member mounting hole is placed in the vicinity of the thermocompression bonding surface beside an electric wire arrangement line.

An embodiment of the first mounting structure of the invention features that the connecting terminal has a fastening portion placed in rear of the thermocompression bonding surface.

According to another aspect of the invention, there is provided a mounting structure (hereunder referred to as a second mounting structure of the invention) in which a connecting terminal is fixed to a mount member and in which a linear element is attached to the connecting terminal. The second mounting structure of the invention features that the connecting terminal has a mount member mounting hole and at least one linear element crimping claw, and that the mount member mounting hole is placed in the vicinity of the linear element crimping claw beside an electric wire arrangement line.

An embodiment (hereunder referred to as a third mounting structure of the invention) of the second mounting structure of the invention features that the connecting terminal has a fastening portion placed in rear of the linear element crimping claw.

An embodiment (hereunder referred to as a fourth mounting structure of the invention) of one of the first to third mounting structures of the invention features that the connecting terminal has a flange stiffening a terminal body.

An embodiment (hereunder referred to as a fifth mounting structure of the invention) of the fourth mounting structure of the invention features that the flange curves toward the fastening portion from the terminal body.

An embodiment of one of the second to fifth mounting structures of the invention features that the mounting structure has a pair of the linear element crimping claws, and that the pair of the linear element crimping claws are apart from each other by a predetermined non-interactive distance.

According to the invention, even in a case where a connecting terminal (e.g., a ground terminal) is fixed a mount member (e.g., a vehicle body panel) with a fastening tool (e.g., a blot and a nut), a linear element (e.g., an electric wire) can easily be removed from the mount member without removing the fastening member.

Also, because it is unnecessary to form the break groove in the connecting terminal, the electric resistance value can be prevented from increasing when electric current is applied thereto.

Additionally, because it is useful for setting a linear-element removing force at a low level to weaken a crimping force and a thermocompression bonding force, factors of variations in manufacturing are difficult to be involved in the mounting structure, and the application of the mounting structure to mass-produced goods is facilitated, even in a case where the linear-element removing force is set to be low.

Further, the component cost and the manufacturing cost of the mounting structure can be suppressed to low levels, respectively, by setting a mount member mounting hole close to a thermocompression bonding surface and each linear element crimping claw to thereby reduce the moment of the connecting terminal.

Furthermore, the paired linear-element crimping claws are separated from each other by a predetermined non-interactive distance to disperse the crimping forces due to the linear element crimping claws, so that the peak value of the resultant crimping force is lowered. Consequently, the linear element can easily be peeled off.

DETAILED DESCRIPTION OF THE PREFERRED EMBODIMENTS

Hereinafter, embodiments of the invention are described with reference to the accompanying drawings.

First Embodiment

Figure 1:
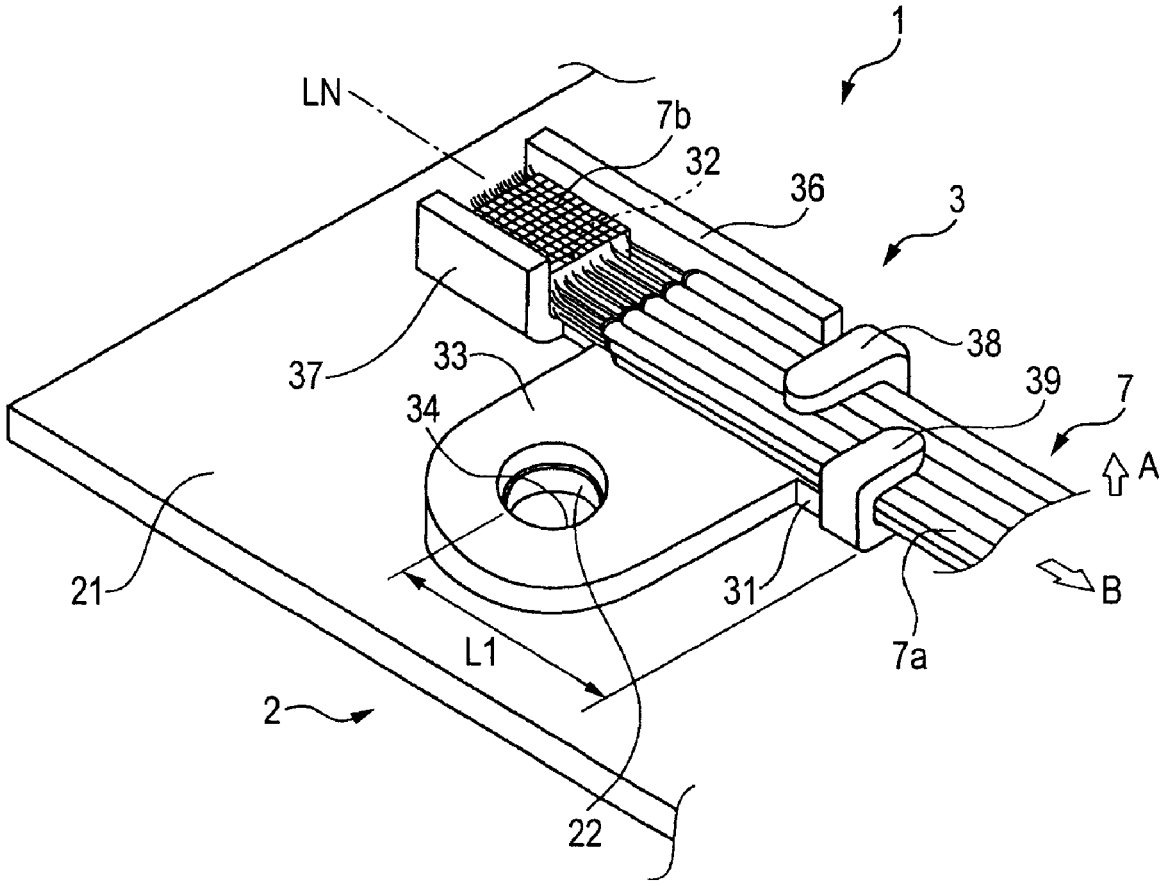
FIG. 1 is a perspective view illustrating a first embodiment of a mounting structure according to the invention.

FIG. 1 is a perspective view illustrating a first embodiment of a mounting structure according to the invention.

As shown in FIG. 1, the mounting structure 1 has a vehicle body panel (corresponding to the mount member) 2. A ground terminal (corresponding to the connecting terminal) 3 is fixed to the vehicle body panel 2 by bolt-fastening. An electric wire (corresponding to the linear element) 7 is attached to the ground terminal 3 by thermocompression-bonding and crimping.

That is, as illustrated in FIG. 1, the vehicle body panel 2 has a flat-plate-like panel body 21 in which a cross-sectionally circular bolt insertion hole 22 is bored.

Also, as illustrated in FIG. 1, the ground terminal 3 has a substantially rectangular terminal body 31. An annular fastening portion 33 is formed in a central portion of the terminal body 31. A cross-sectionally circular vehicle body mounting hole 34 is bored in a central portion of the fastening portion 33. Also, a thermocompression bonding surface 32 is formed on an end (i.e., a left end, as viewed in FIG. 1) of the terminal body 31. Electric wire crimping claws 38 and 39 are provided on both sides of the other end (i.e., a right end, as viewed in FIG. 1) at positions respectively staggered in a longitudinal direction (i.e., a lateral direction, as viewed in FIG. 1) of the terminal body 31 so as to extend upwardly. Incidentally, the vehicle mounting hole 34 is positioned besides an electric wire arrangement line LN in the vicinity of the electric wire crimping claws 38 and 39. More specifically, the distance L1 between the vehicle body mounting hole 34 and each of the electric wire crimping claws 38 and 39 is set to be shorter than the length of the terminal body 31 in an electric wire arrangement direction (i.e., a direction in which the thermocompression surface 32 and the electric wire crimping claws 38 and 39 are connected in this order). Further, the flanges 36 and 37 are erected on both sides of the terminal body 31 to stiffen the terminal body 31. That is, the flanges 36 and 37 are perpendicular to the terminal body 31 and extend in the electric wire arrangement direction to thereby enhance the stiffness of the terminal body 31.

Also, as illustrated in FIG. 1, the ground terminal 3 is fixed to the vehicle body panel 2 by inserting a bolt (not shown) into the vehicle body mounting hole 34 and the bolt insertion hole 22 of the vehicle body panel 2 and by also screwing a nut (not shown) onto the bolt. Further, because the ground terminal 3 is placed beside the electric wire arrangement line LN, the ground terminal 3 is such that the vehicle body mounting hole 34 can be provided at an optional position in the electric wire arrangement direction so as to prevent occurrence of interference between the vehicle body mounting hole 34 and each of the thermocompression bonding surface 32 and the electric wire crimping claws 38 and 39. Thus, the flexibility at the mounting of the ground terminal 3 can be enhanced. Moreover, the electric wire 7 is attached to the ground terminal 3 by crimping a coating portion 7*a* with the electric wire crimping claws 38 and 39 of the ground terminal 3 and by also thermocompression-bonding the thermocompression bonding portion 7*b* of a bare wire to the thermocompression bonding surface 32 of the ground terminal 3 thereby to conduct the thermocompression bonding portion 7*b*. A known method disclosed in JP-A-6-132041 can be employed as a concrete thermocompression bonding method.

Incidentally, the ground terminal 3 is such that each of a crimping force and a thermocompression bonding force is set to be weaker than a fixing force. The "crimping force" means a force of crimping the electric wire 7 with the electric wire crimping claws 38 and 39 of the ground terminal 3. Further, the "thermocompression bonding force" means a force of thermocompression bonding the electric wire 7 with the thermocompression bonding surface 32 of the ground terminal 3. Furthermore, the "fixing force" means a force of fixing the ground terminal 3 to the vehicle body panel 2 by bolt-fastening.

The mounting structure 1 has the aforementioned configuration. Thus, at the disassembling of a vehicle or at the replacement of the electric wire 7, the electric wire 7 is removed from the vehicle body panel 2 according to the following procedure.

First, the coating portion 7*a* of the electric wire 7 is bent nearly at right angles. Additionally, the electric wire 7 is peeled off in a direction (i.e., a direction designated by arrow A shown in FIG. 1) perpendicular to the thermocompression bonding surface 32 of the ground terminal 3. Then, simultaneously with the application of a force, which acts in the direction of arrow A, to the electric crimping claws 38 and 39 in the ground terminal 3, an opposite force acts on the fastening portion 33.

At that time, as described above, the crimping force is weaker than the fixing force. Thus, the two electric wire crimping claws 38 and 39 are unfolded. The electric wire 7 is released therefrom. Further, because the electric wire crimping claws 38 and 39 are positioned in the vicinity of the vehicle body mounting hole 34, the ground terminal 3 can be suppressed from being lifted as an operation of pulling the electric wire 7 in the direction of arrow A is performed when the electric wires 38 and 39 are unfolded by performing such an operation. Additionally, because the terminal body 31 is stiffened by the flanges 36 and 37, the terminal body 31 does not sag when the electric wire 7 is pulled. Consequently, a load can efficiently be applied to the electric wire 7 without lifting the ground terminal 3.

When the two electric wire crimping claws 38 and 39 are unfolded to thereby release the electric wire 7, a pulling force acting in the direction of arrow A is applied to the thermocompression bonding portion 7*b* of the electric wire 7 this time. Then, an opposite force acts upon a vehicle body fixing claw 35, simultaneously with applying the force in the direction of arrow A when the ground terminal 3 is pulled by the electric wire 7. At that time, because the thermocompression bonding force is weaker than the fixing force, as described above, the thermocompression bonding portion 7*b* is peeled off from the ground terminal 3, so that the vehicle body fixing claw 35 remains engaged with a terminal engaging hole 23 of the vehicle body panel 2.

Incidentally, because the thermocompression bonding portion 7*b* is pulled in the direction of arrow A, that is, a direction perpendicular to the thermocompression bonding surface 32 of the bonding terminal 3, the thermocompression bonding portion 7*b* can be peeled off by a force weaker than a force used in the case of pulling the thermocompression bonding portion 7*b* in the direction of arrow B, that is, a direction parallel to the thermocompression bonding surface 32.

Then, an operation of removing the electric wire 7 is finished.

Thus, the mounting structure 1 excels in the disassemblability of the electric wire 7. The electric wire 7 can easily be detached from the vehicle body panel 2 without removing the bolt and the nut, with which the ground terminal 3 is attached to the vehicle body panel 2, and without using heavy machinery.

Additionally, even when the electric wire 7 is removed from the ground terminal 3, apart of the ground terminal 3 is not associated with the electric wire 7, differently from the conventional method according to which the ground terminal 3 is divided into two along the break groove. Accordingly, the electric wire 7 detached from the vehicle body panel 2 can be reused by being recycled without being modified.

Also, the process of narrowing the electric path is not performed on the ground terminal 3, differently from the conventional method of forming the break groove in the ground terminal 3. Thus, the electric resistance value can be prevented from being increased when the terminal 3 is energized.

Moreover, it is useful for setting a detaching force at a low level to weaken the crimping force and the thermocompression bonding force of the ground terminal 3. Thus, even in a case where the detaching force used to detach the electric wire 7 is set at a low level, factors of variations in manufacturing are difficult to be involved, and the application of the mounting structure to mass-produced goods is facilitated, Furthermore, it is sufficient to provide only the bolt insertion hole 22 in the vehicle body panel 2. It is unnecessary to provide the terminal engaging hole in the vehicle body panel 2 and to provide the vehicle body fixing hole in the ground terminal 3. Therefore, the component cost of the mounting structure 1 can be suppressed to low level.

Additionally, when the ground terminal 3 is fixed to the vehicle body panel 2, an operation of fixing the ground terminal 3 can easily be performed while the bolt insertion hole 22 of the vehicle body panel 2 and the vehicle body mounting hole 34 of the ground terminal 3 are visually observed. Thus, no blind work is constrained. Accordingly, the manufacturing cost of the mounting structure 1 can be suppressed to low level.

Second Embodiment

Figure 2:
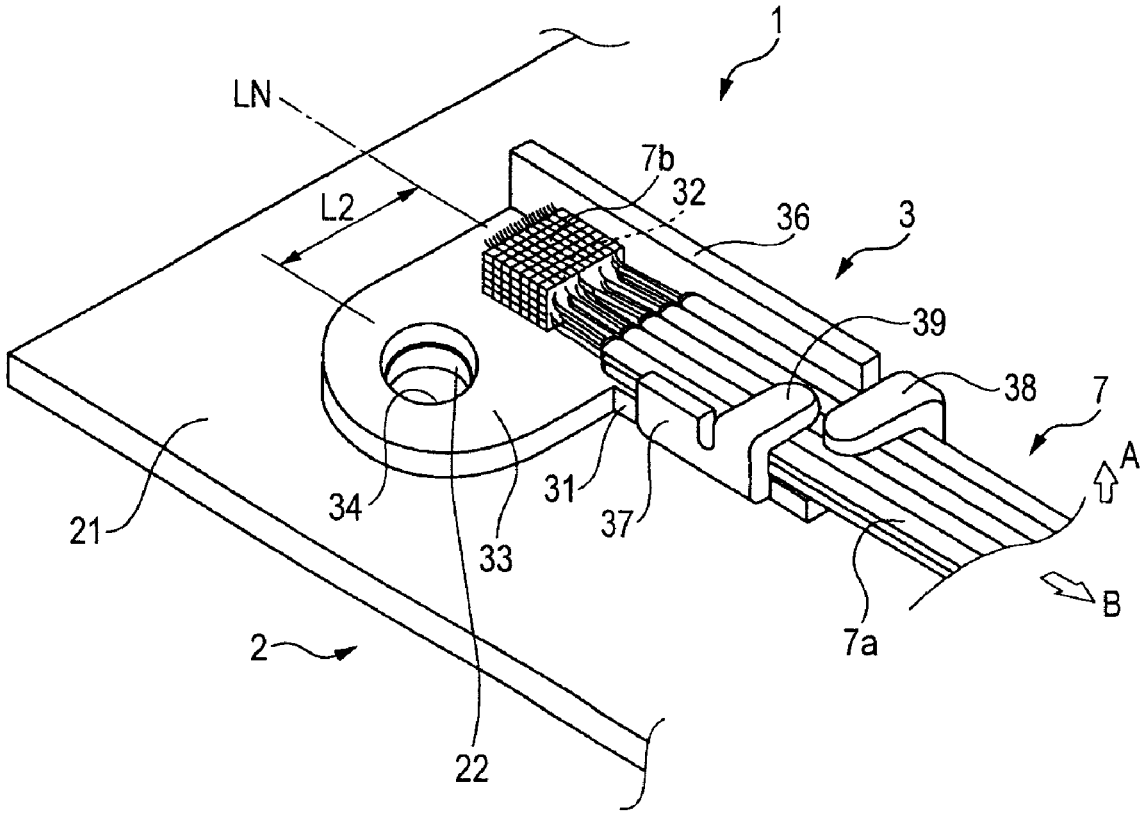
FIG. 2 is a perspective view illustrating a second embodiment of the mounting structure according to the invention.

FIG. 2 is a perspective view illustrating a second embodiment of the mounting structure according to the invention.

As illustrated in FIG. 2, a mounting structure 1 of this embodiment is configured so that a fastening portion 33 is formed just beside a thermocompression bonding surface 32. A vehicle body mounting hole 34 is placed in the vicinity of the thermocompression bonding surface 32. More specifically, the distance in an electric wire arrangement direction between the vehicle body mounting hole 34 and the thermocompression bonding surface 32 is set to be 0. Also, the distance L2 in an electric wire arrangement orthogonal direction (i.e., a direction perpendicular to the electric wire arrangement direction) between the vehicle body mounting hole 34 and the thermocompression bonding surface 32 is set to be shortest in a range of the distance which does not disturb an operation of fastening a bolt.

Further, the remaining constituents of the second embodiment are the same as the corresponding constituents of the first embodiment. Thus, the second embodiment has the same advantages as those of the first embodiment.

Third Embodiment

FIG. 2 is a perspective view illustrating a second embodiment of the mounting structure according to the invention. FIG. 4 is an exploded perspective view illustrating a moment generating state in a ground terminal of the mounting structure shown in FIG. 3.

Figure 3:
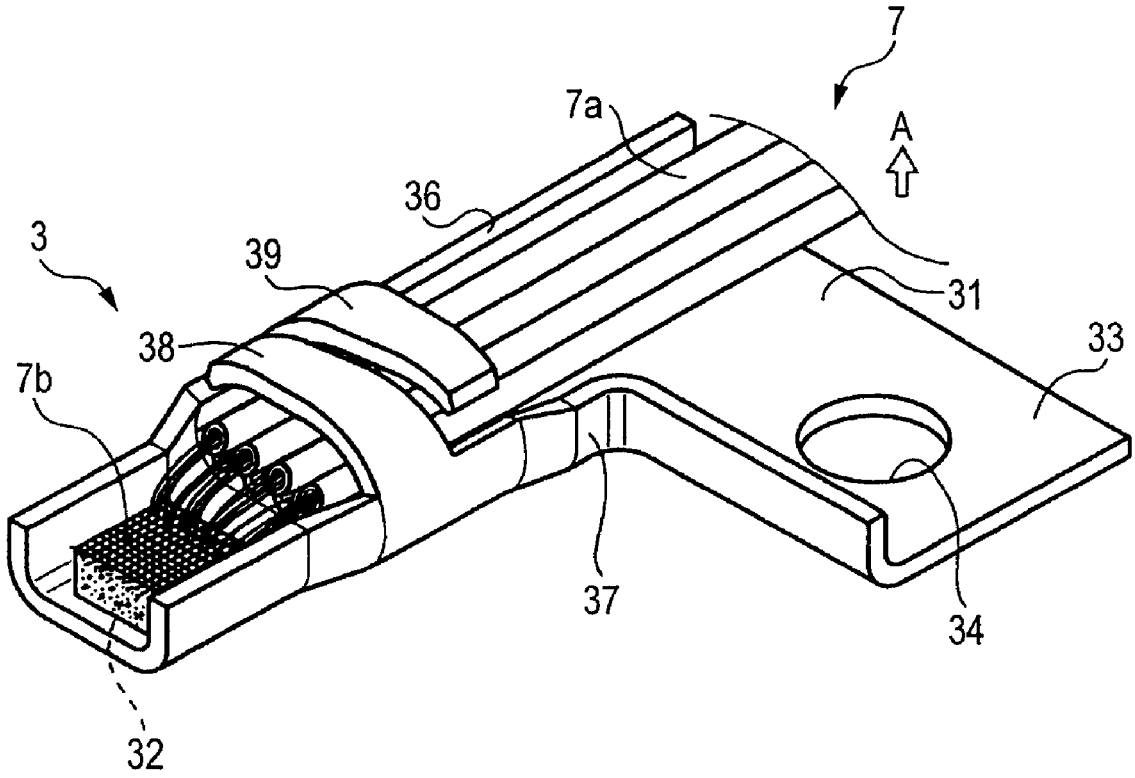
FIG. 3 is a perspective view illustrating a third embodiment of the mounting structure according to the invention.
Figure 4:
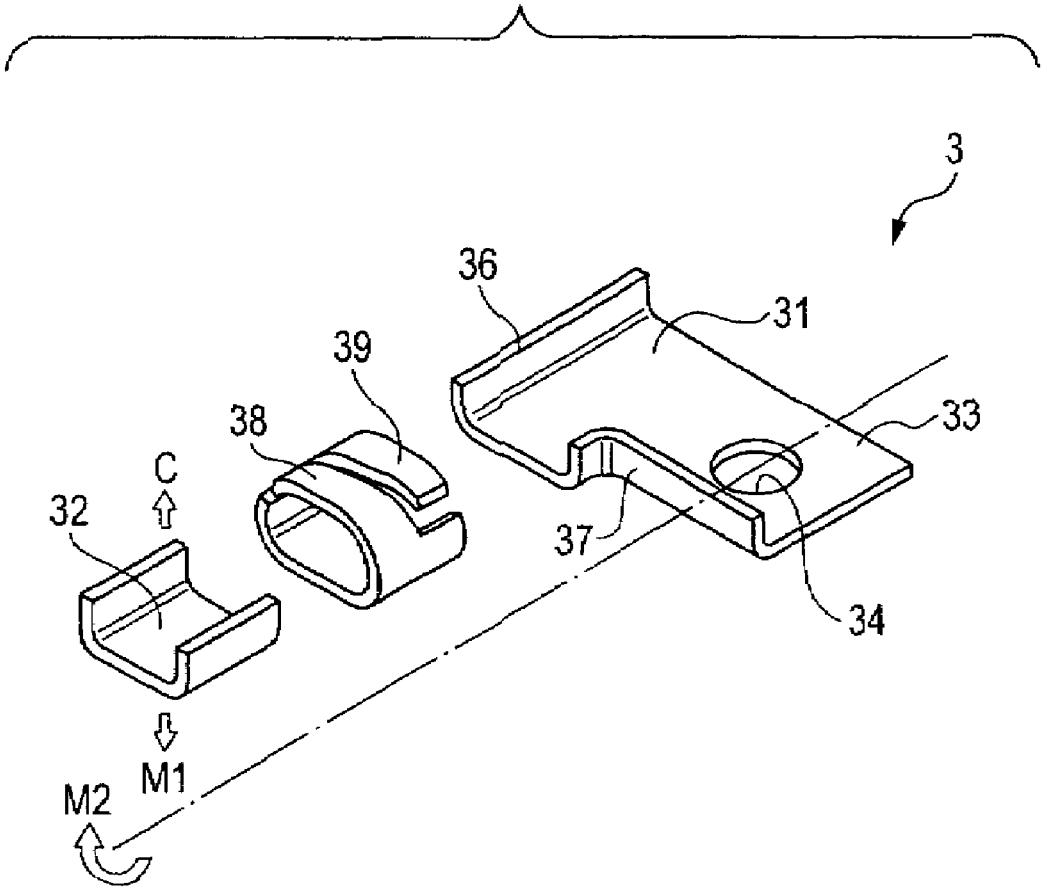
FIG. 4 is an exploded perspective view illustrating a moment generating state in a ground terminal of the mounting structure shown in FIG. 3.

As illustrated in FIG. 3, a mounting structure 1 of this embodiment is configured so that a thermocompression bonding surface 32, electric wire crimping claws 38 and 39, and a fastening portion 33 are arranged in a ground terminal 3 in this order. Thus, the fastening portion 33 is positioned in rear of the electric wire crimping claws 38 and 39. Additionally, one of flanges 37 is erected to be curved like a letter "L" from a terminal body 31 to the fastening portion 33.

Further, the remaining constituents of the third embodiment are the same as the corresponding constituents of the first embodiment. Thus, the third embodiment has the same advantages as those of the first embodiment.

Additionally, the ground terminal 3 is configured so that the fastening portion 33 is placed in rear of the electric crimping claws 38 and 39. Thus, when the electric wire 7 is pulled in the direction of arrow A and the electric wire crimping claws 38 and 39 are unfolded, the terminal body 31 does not vertically lift. Accordingly, an operation of detaching the electric wire 7 can smoothly be performed.

Also, the ground terminal 3 is configured so that the fastening portion 33 is positioned in rear of the thermocompression bonding surface 32. Thus, when the electric wire 7 is pulled in the direction of arrow A and the thermocompression bonding portion 7*b* is peeled off from the ground terminal 3, the easily peeling property of the electric wire 7 appears. That is, as illustrated in FIG. 4, the ground terminal 3 is shaped so that the fastening portion 33 is offset with respect to the thermocompression bonding surface 32 and the electric wire crimping claws 38 and 39. Consequently, when a force acting in the direction of arrow C is applied to the thermocompression bonding portion 7*b* of the electric wire 7, a moment M1 acts in the direction (i.e., a downward direction, as viewed in FIG. 4), in which the ground terminal 3 is pressed against the vehicle body panel, until the electric wire crimping claws 38 and 39 are unfolded. Subsequently, when the electric wire crimping claws 38 and 39 are unfolded and a load starts to be applied onto the thermocompression bonding surface 32, a moment M2 acts, so that the ground terminal 3 rises while being curved. Consequently, the force acting in the direction of arrow C is transmitted to the core wire of the electric wire 7 thermocompression-bonded to the thermocompression bonding surface 32 by being twisted. Accordingly, the electric wire 7 can easily be peeled off from the ground terminal 3.

Furthermore, because the flange 37 is curved to the fastening portion 33 from the terminal body 31, not only the terminal body 31 but the fastening portion 33 can be prevented from sagging when the electric wire 7 is pulled. Consequently, the electric wire 7 can more easily be peeled off from the ground terminal 3.

Incidentally, the electric wire crimping claws 38 and 39 are reinforcing portions against a peeling force. Unless the electric wire crimping claws 38 and 39 are unfolded, no force is applied to the thermocompression bonding surface 32. The electric wire crimping claws 38 and 39 serve as indicators. When the electric wire crimping claws 38 and 39 are being unfolded, a force is applied to the thermocompression bonding surface 32. This indicates that the electric wire 7 may be detached. In a case where the electric wire crimping claws 38 and 39 reliably are crimped, there is no possibility that a force is applied to the thermocompression bonding surface 32. The electric wire crimping claws 38 and 39 indicates that there is no possibility that the thermocompression bonding surface 32 is not detached by peeling.

Fourth Embodiment

Figure 5:
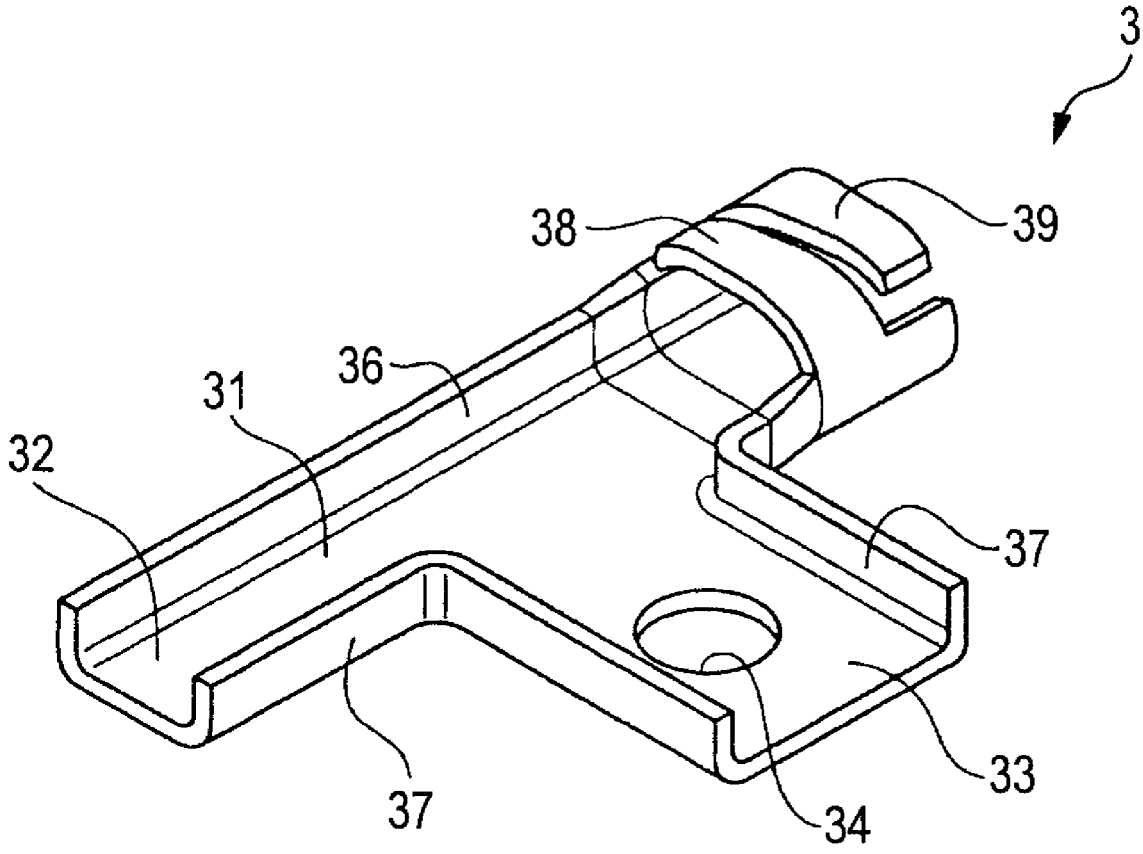
FIG. 5 is a perspective view illustrating a ground terminal of a fourth embodiment of the mounting structure according to the invention.
Figure 6:
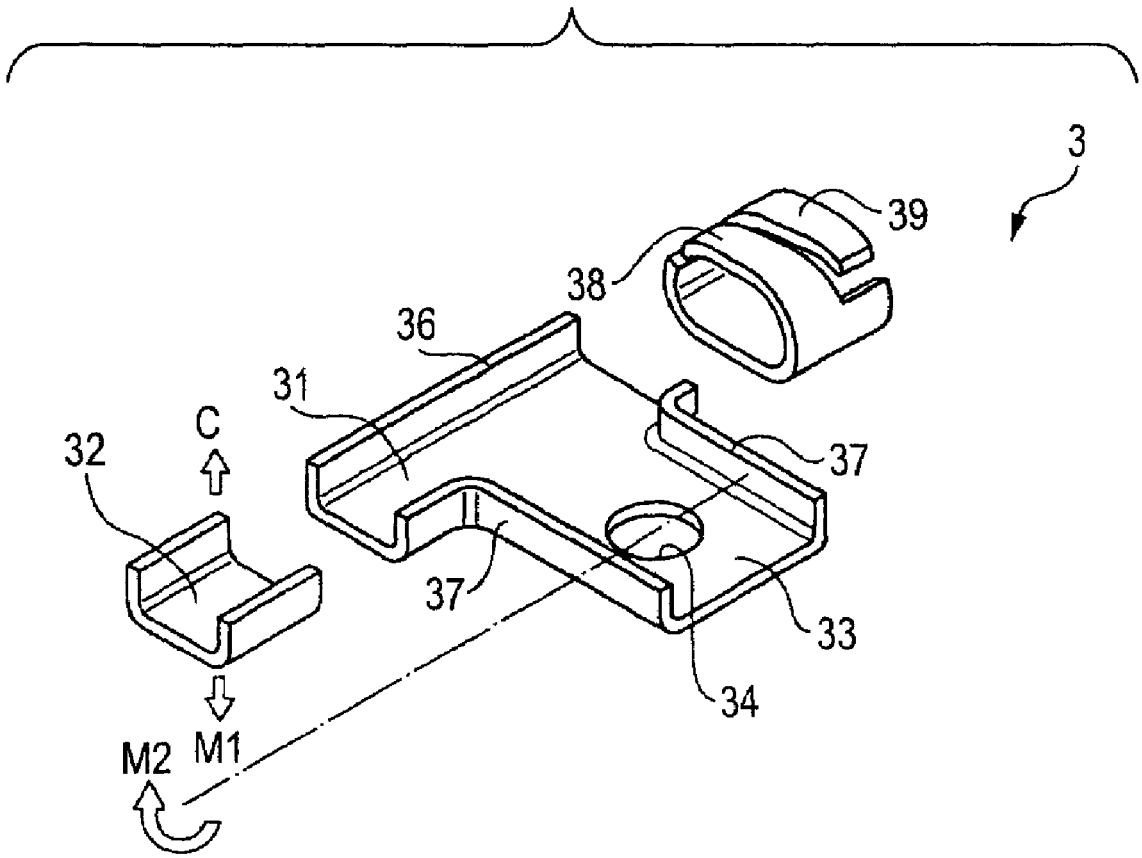
FIG. 6 is an exploded perspective view illustrating a moment generating state in the ground terminal shown in FIG. 5.

FIG. 5 is a perspective view illustrating a ground terminal of a fourth embodiment of the mounting structure according to the invention. FIG. 6 is an exploded perspective view illustrating a moment generating state in the ground terminal shown in FIG. 5.

As illustrated in FIG. 5, a mounting structure 1 of this embodiment is configured so that a thermocompression bonding surface 32, a fastening portion 33, and electric wire crimping claws 38 and 39 are arranged in a ground terminal 3 in this order. Thus, the fastening portion 33 is positioned in rear of the thermocompression bonding surface 32. Additionally, one of flanges 36 is erected on one of sides of the terminal body 31. The other flange 37 is erected to be curved like a letter "L" from the terminal body 31 to the fastening portion 33. Incidentally, the illustration of the electric wire 7 is omitted in FIG. 5.

Further, the remaining constituents of the third embodiment are the same as the corresponding constituents of the first embodiment. Thus, the third embodiment has the same advantages as those of the first embodiment.

Additionally, the ground terminal 3 is configured so that the fastening portion 33 is positioned in rear of the thermocompression bonding surface 32. Thus, when the electric wire (not shown) is pulled and the thermocompression bonding portion 7*b* is peeled off from the ground terminal 3, the easily peeling property of the electric wire appears. That is, as illustrated in FIG. 6, the ground terminal 3 is shaped so that the fastening portion 33 is offset with respect to the thermocompression bonding surface 32 and the electric wire crimping claws 38 and 39. Consequently, when a force acting in the direction of arrow C is applied to the thermocompression bonding portion 7*b* of the electric wire 7, a moment M1 acts in the direction (i.e., a downward direction, as viewed in FIG. 6), in which the ground terminal 3 is pressed against the vehicle body panel, until the electric wire crimping claws 38 and 39 are unfolded. Subsequently, when the electric wire crimping claws 38 and 39 are unfolded and a load starts to be applied onto the thermocompression bonding surface 32, a moment M2 acts, so that the ground terminal 3 rises while being curved. Consequently, the force acting in the direction of arrow C is transmitted to the core wire of the electric wire 7 thermocompression-bonded to the thermocompression bonding surface 32 by being twisted. Accordingly, the electric wire 7 can easily be peeled off from the ground terminal 3.

Furthermore, because the flange 37 is curved to the fastening portion 33 from the terminal body 31, not only the terminal body 31 but the fastening portion 33 can be prevented from sagging when the electric wire 7 is pulled. Consequently, the electric wire 7 can more easily be peeled off from the ground terminal 3.

Incidentally, the electric wire crimping claws 38 and 39 are reinforcing portions against a peeling force. Unless the electric wire crimping claws 38 and 39 are unfolded, no force is applied to the thermocompression bonding surface 32. The electric wire crimping claws 38 and 39 serve as indicators. When the electric wire crimping claws 38 and 39 are being unfolded, a force is applied to the thermocompression bonding surface 32. This indicates that the electric wire 7 may be detached. In a case where the electric wire crimping claws 38 and 39 reliably are crimped, there is no possibility that a force is applied to the thermocompression bonding surface 32. The electric wire crimping claws 38 and 39 indicates that there is no possibility that the thermocompression bonding surface 32 is not detached by peeling.

Fifth Embodiment

Figure 7:
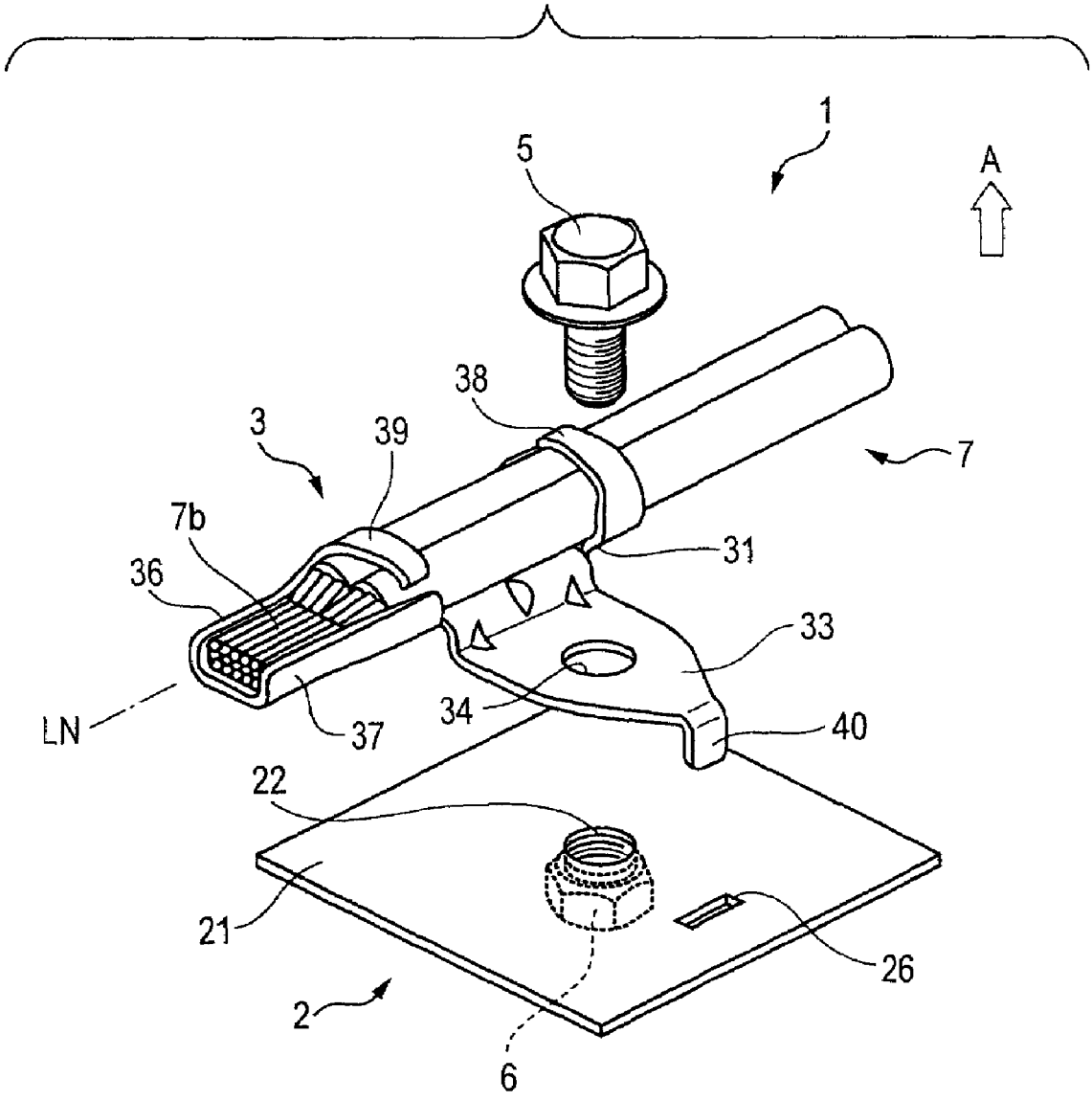
FIG. 7 is a perspective view illustrating a ground terminal of a fifth embodiment of the mounting structure according to the invention.
Figure 8:
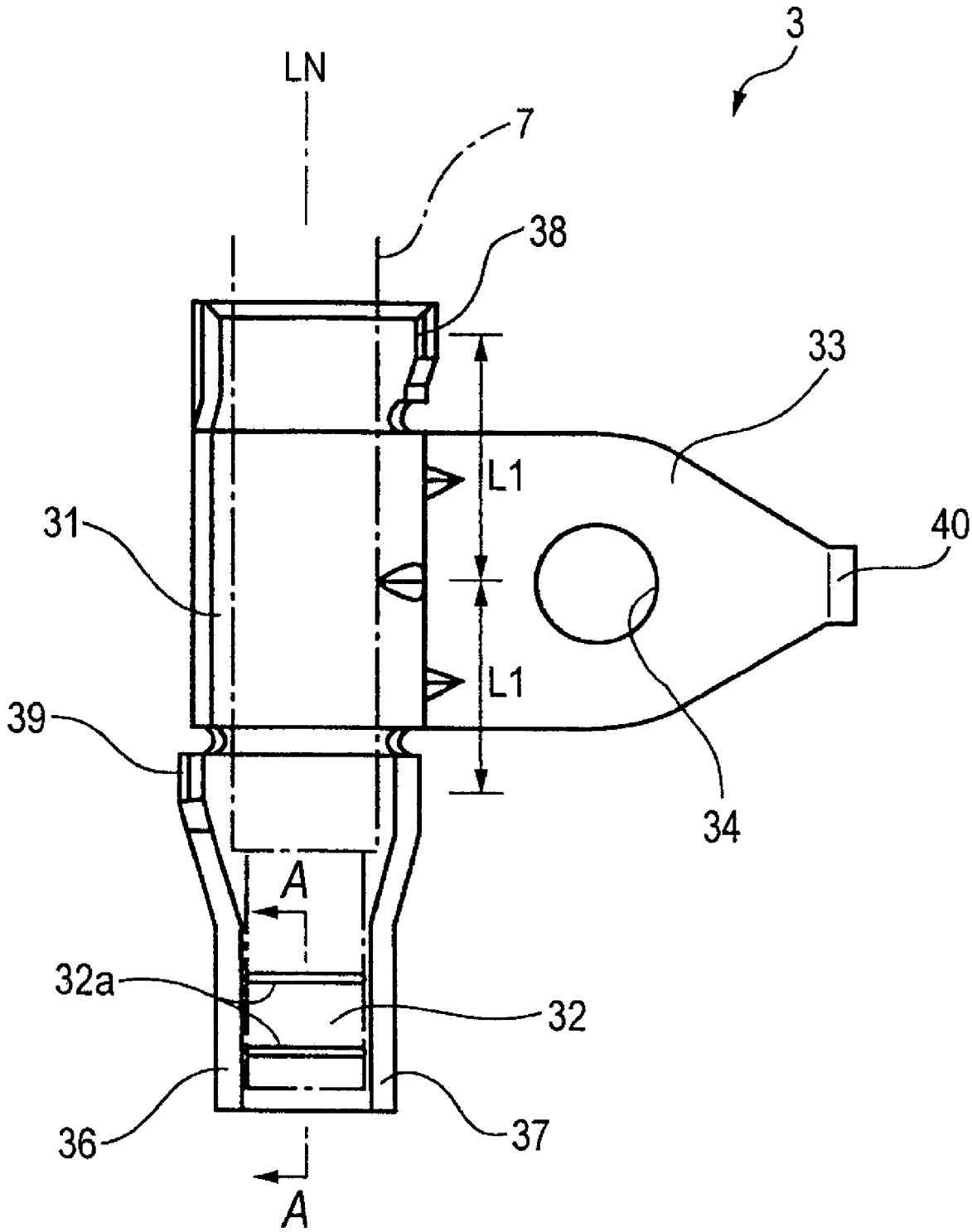
FIG. 8 is a plan view of the ground terminal of the mounting structure shown in FIG. 7.
Figure 9:
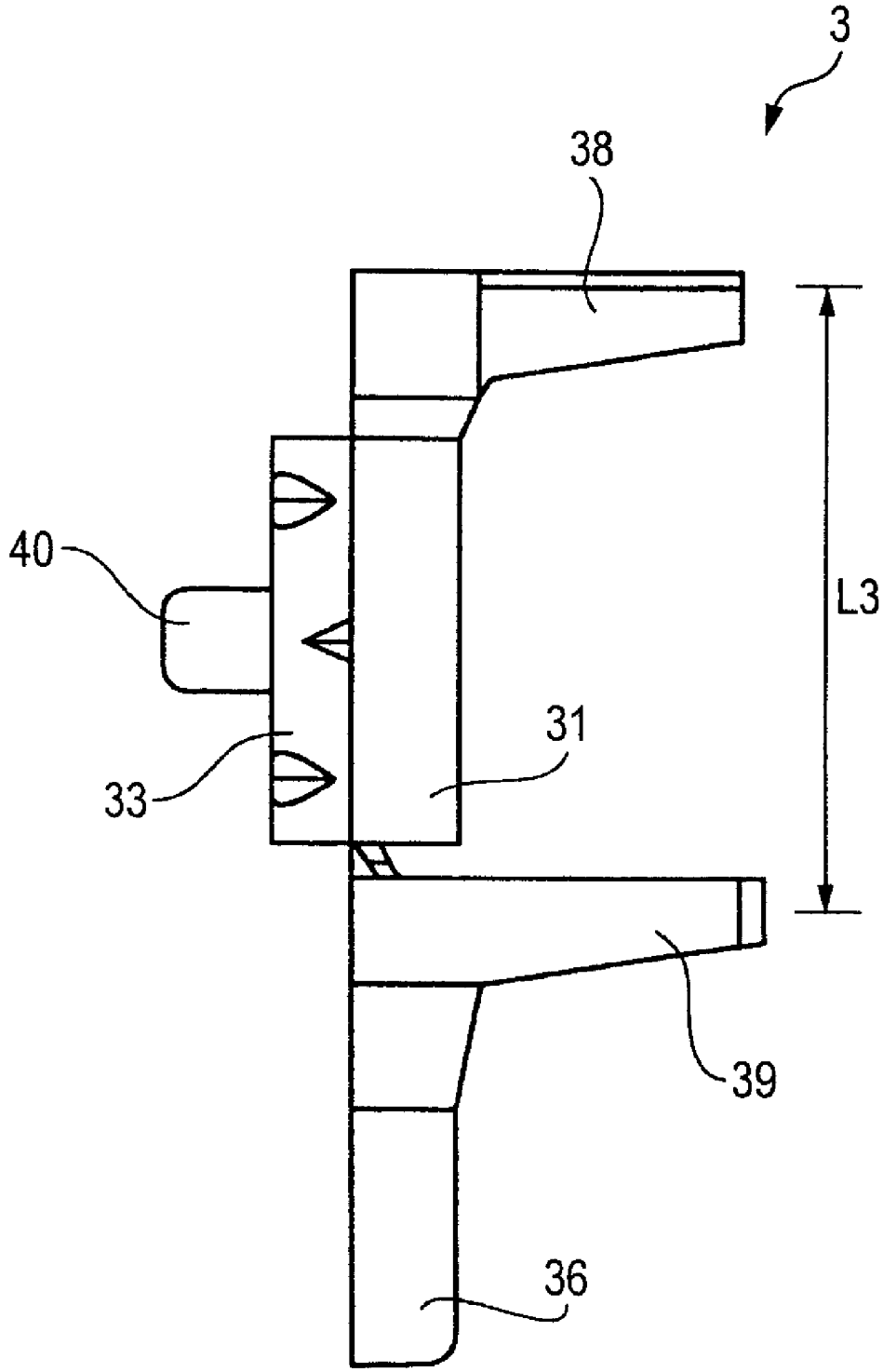
FIG. 9 is a left side view of the ground terminal shown in FIG. 8.
Figure 10:
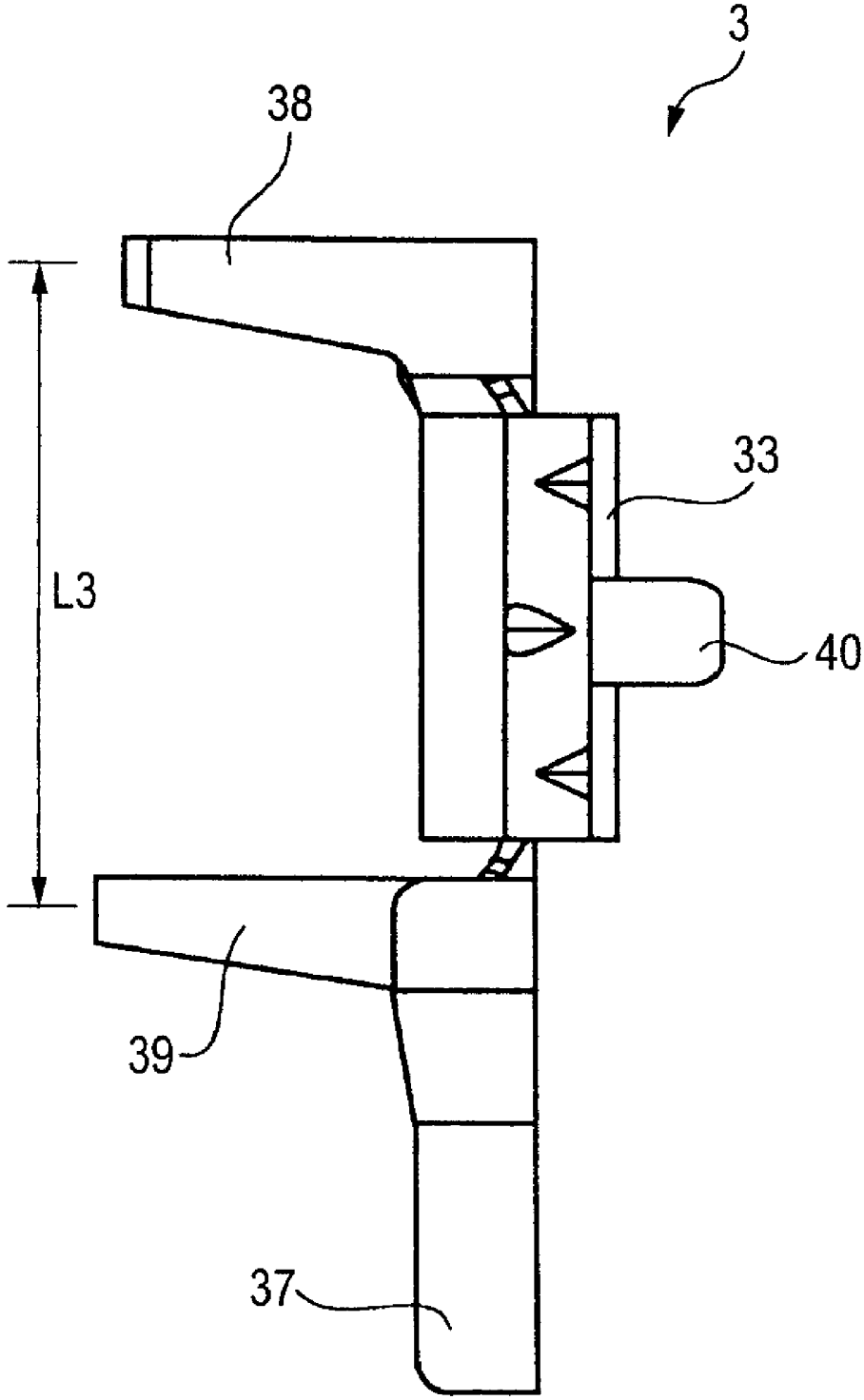
FIG. 10 is a right side view of the ground terminal shown in FIG. 8.
Figure 11:
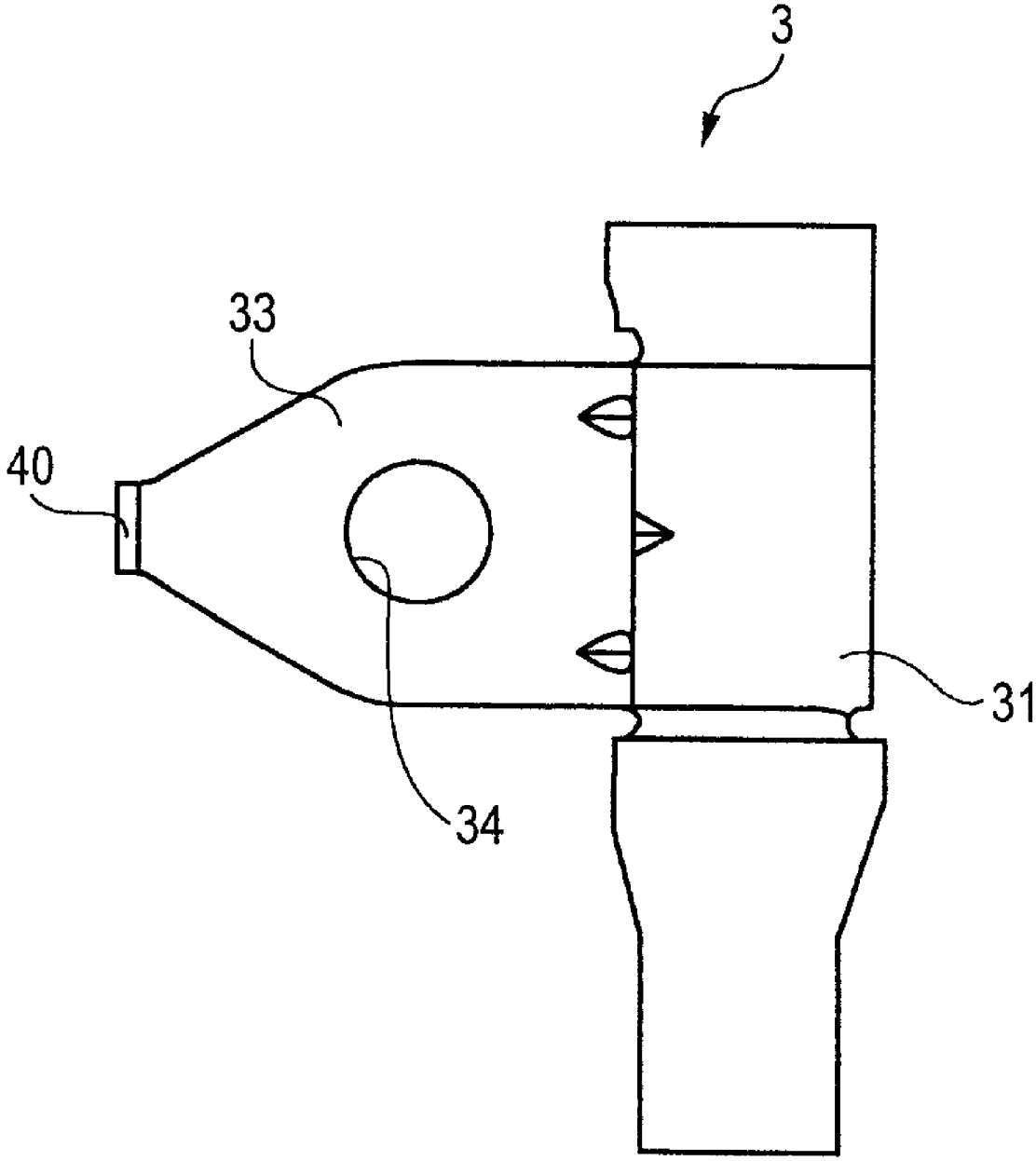
FIG. 11 is a bottom view of the ground terminal shown in FIG. 8.
Figure 12:
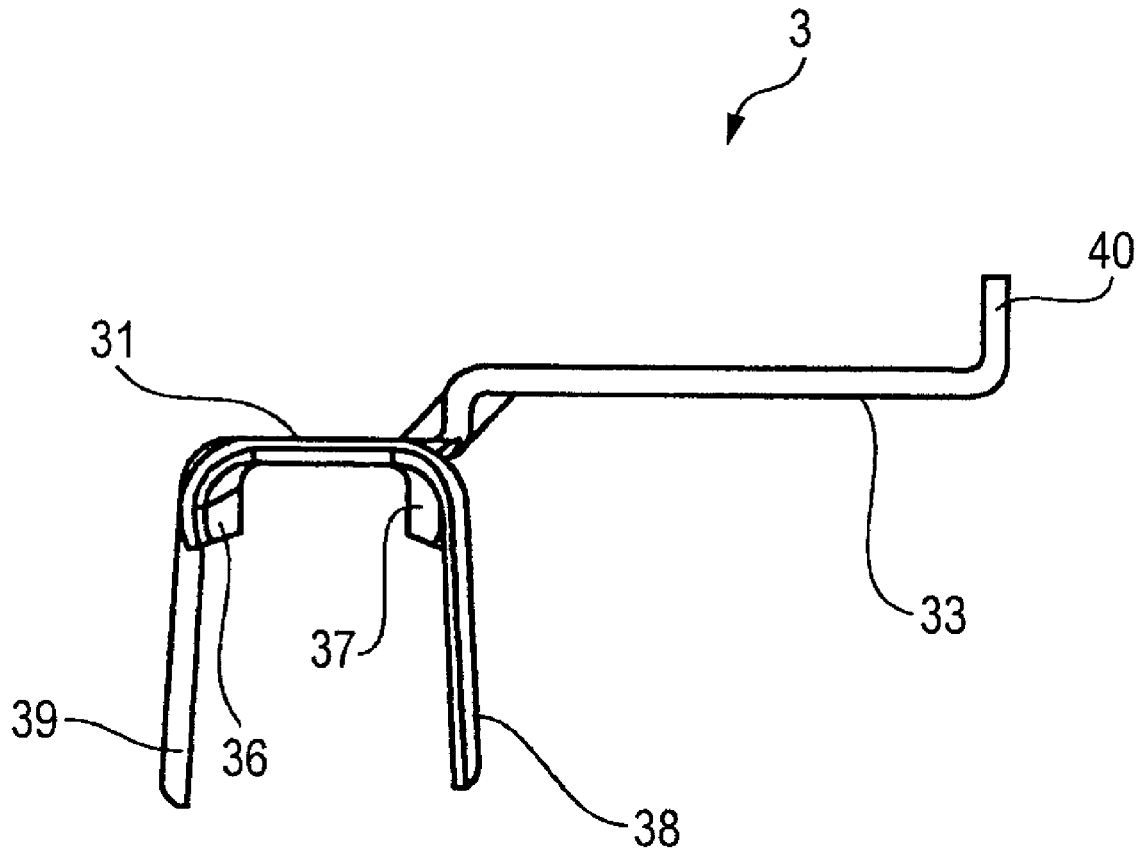
FIG. 12 is a front view of the ground terminal shown in FIG. 8.
Figure 13:
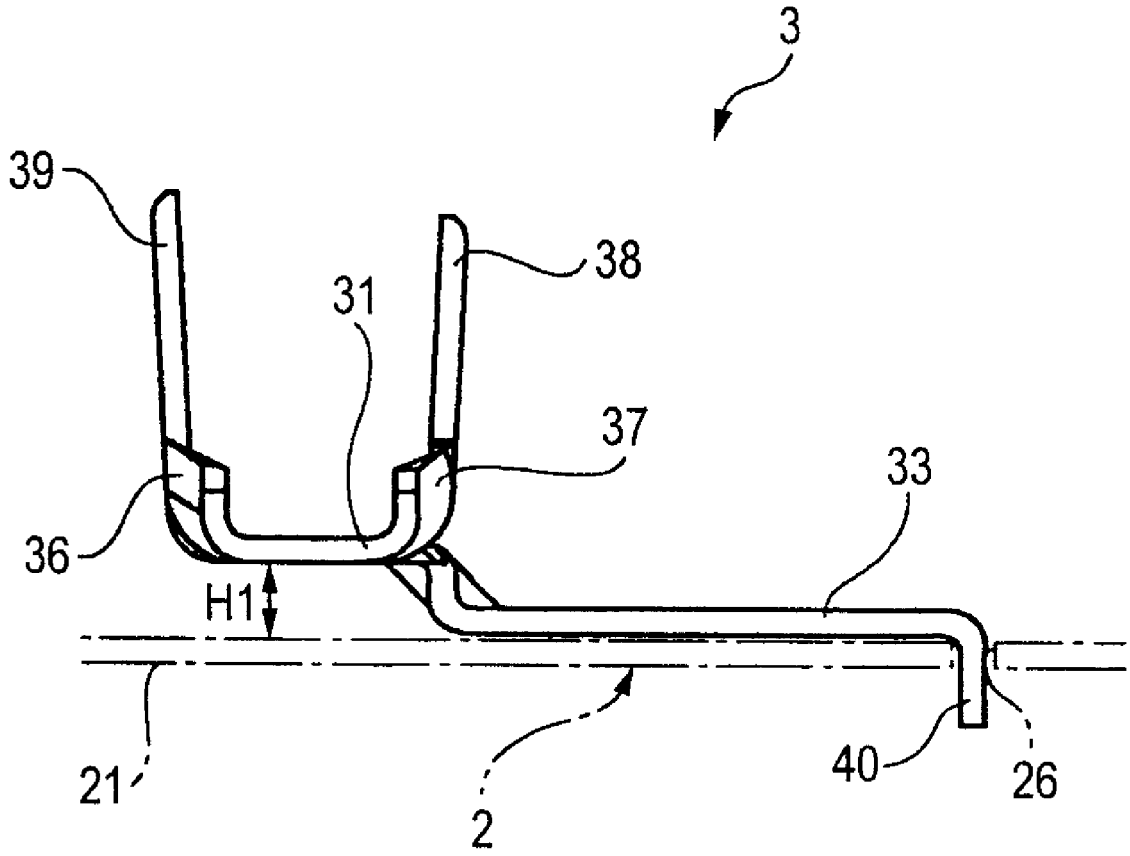
FIG. 13 is a rear view of the ground terminal shown in FIG. 8.
Figure 14:
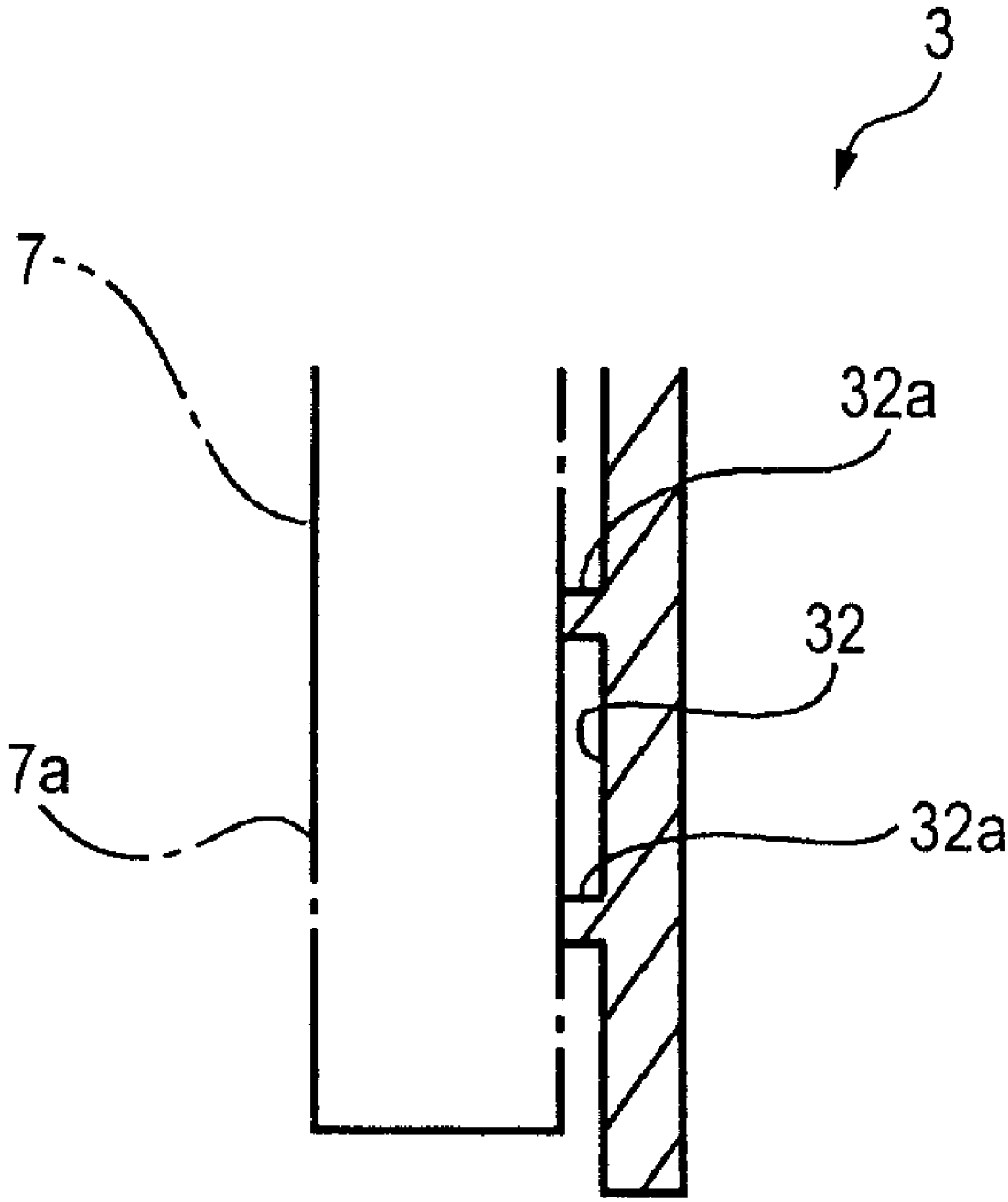
FIG. 14 is an end view of the ground terminal taken line A-A shown in FIG. 8.
Figure 15A:
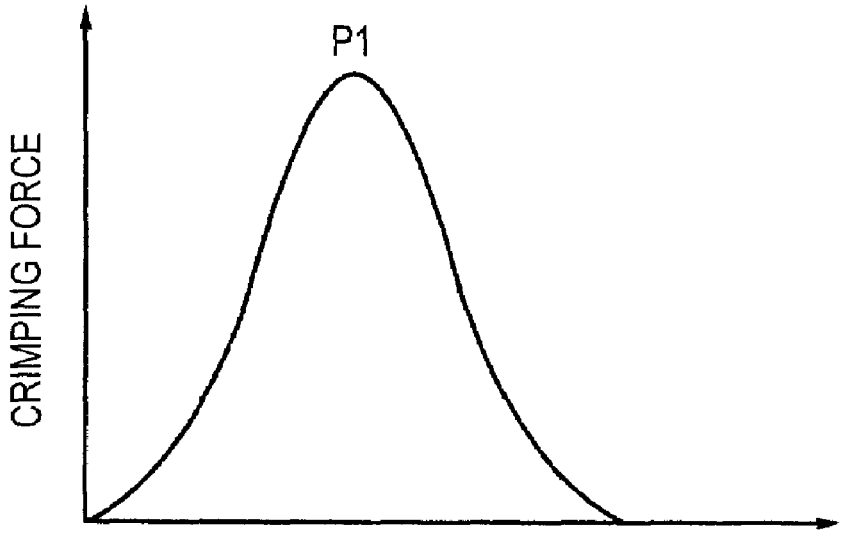
FIGS. 15A and 15B are graphs each illustrating a load characteristic at the time of peeling off an electric wire.
Figure 15B:
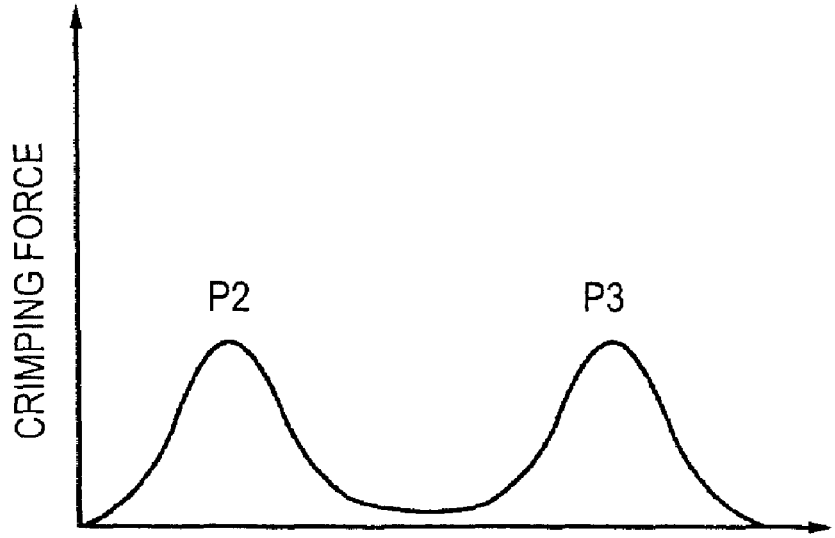

FIG. 7 is an exploded perspective view illustrating a fifth embodiment of the mounting structure according to the invention. FIG. 8 is a plan view of the ground terminal of the mounting structure shown in FIG. 7. FIG. 9 is a left side view of the ground terminal shown in FIG. 8. FIG. 10 is a right side view of the ground terminal shown in FIG. 8. FIG. 11 is a bottom view of the ground terminal shown in FIG. 8. FIG. 12 is a front view of the ground terminal shown in FIG. 8. FIG. 13 is a rear view of the ground terminal shown in FIG. 8. FIG. 14 is an end view of the ground terminal taken line A-A shown in FIG. 8. FIGS. 15A and 15B are graphs each illustrating a load characteristic at the time of peeling off an electric wire.

As shown in FIG. 7, a mounting structure 1 has a vehicle body panel (corresponding to the mount member) 2. A ground terminal (corresponding to the connecting terminal) 3 is fixed to the vehicle body panel 2 by bolt-fastening. An electric wire (corresponding to the linear element) 7 is attached to the ground terminal 3 by thermocompression-bonding and crimping.

That is, as illustrated in FIG. 7, the vehicle body panel 2 has a flat-plate-like panel body 21 in which a cross-sectionally circular bolt insertion hole 22 is bored. A cross-sectionally rectangularly-shaped whirl-stop engaging hole 26 is bored in the vicinity of the bolt insertion hole 22. Moreover, a nut 6 is welded just under the bolt insertion hole 22 in the rear surface of the panel body 21.

Further, as illustrated in FIGS. 7 to 13, the ground terminal 3 has a substantially rectangular terminal body 31. A pentagon-shaped fastening portion 33 is formed on the terminal body 31 at a position lower than the terminal body 31 by a predetermined height H1 (e.g., H1=3 to 5 mm) and to extend in a direction perpendicular to the longitudinal direction of the terminal body 31. A circularly-shaped vehicle body mounting hole 34 is bored in the central portion of the fastening portion 33 beside the electric wire arrangement line LN. A whirl-stop piece 40 is downwardly and continuously provided at an end portion of the fastening portion 33.

Also, the thermocompression bonding surface 32 is formed in an end portion (i.e., a bottom end portion, as viewed in FIG. 8) of the terminal body 31. As shown in FIG. 14, two projection ridges 32*a* are provided in parallel with each other on the thermocompression bonding surface 32 to protrude therefrom.

Furthermore, as shown in FIGS. 8 to 13, paired electric wire crimping claws 38 and 39 are provided on both sides of the fastening portion 33 of the terminal body 31 to cross-sectionally diagonally face each other and to upwardly extend. The electric wire crimping claws 38 and 39 are apart from each other in the electric wire arrangement direction (i.e., a up-down direction, as viewed in FIG. 9) by a predetermined non-interactive distance L3. Incidentally, the non-interactive distance L3 means a distance at which the crimping forces due to the electric wire claws 38 and 39 do not overlap each other. More specifically, in a case where the electric wire crimping claws 38 and 39 are made of, for example, oxygen free copper, the non-interactive distance L3 is equal to or more than 16 mm.

Also, as illustrated in FIG. 7, the vehicle body mounting hole 34 is positioned in the vicinity of the electric wire crimping claws 38 and 39. More specifically, the distance L1 in the electric wire arrangement direction (i.e., a direction in which the thermocompression crimping surface 32 is connected to each of the electric wire crimping claws 38 and 39) between the vehicle body mounting hole 34 and each of the electric wire crimping claws 38 and 39 is shorter than the length of the terminal body 31.

Further, as illustrated in FIGS. 7, 8, and 11, the flanges 36 and 37 are respectively erected on both sides of the terminal body 31 to stiffen the terminal body 31. That is, the flanges 36 and 37 are perpendicular to the terminal body 31 and extend in the electric wire arrangement direction to thereby enhance the stiffness of the terminal body 31.

Further, as illustrated in FIG. 7, the ground terminal 3 is fixed to the vehicle body panel 2 by inserting the bolt 5 into the vehicle body mounting hole 34 and the bolt insertion hole 22 of the vehicle body panel 2 and by screwing the nut 6 thereonto. Furthermore, the ground terminal 3 is configured so that because the vehicle body mounting hole 34 is positioned beside the electric wire arrangement line LN, the vehicle body mounting hole 34 is placed at an optional position in the electric wire arrangement direction so as to prevent the interference between the vehicle body mounting hole 34 and each of the thermocompression bonding hole 34 and the electric wire crimping claws 38 and 39. Thus, the flexibility at the attachments of the ground terminal 3 can be enhanced. Additionally, the ground terminal 3 is restrained by engaging the whirl-stop piece 40 with the whirl-stop engaging hole 26, as illustrated in FIGS. 7 and 13, from rotating with respect to the vehicle body panel 2. Consequently, when the ground terminal 3 is attached to the vehicle body panel 2, there is no fear that when the bolt 5 rotates, the ground terminal 3 may corotate with the bolt 5. The ground terminal 3 can be fixed in a prescribed direction to the vehicle body panel 2.

Meanwhile, the thermocompression bonding portion 7*b* of a bare wire is thermocompression-bonded to the ridge 32*a* formed on the thermocompression bonding surface 32 of the ground terminal 3 and is then conducted. Further, the coating portion 7*a* is crimped by the electric wire crimping claws 38 and 39 of the ground terminal 3. Thus, the electric wire 7 is fixed to the ground terminal 3. A publicly known method disclosed in JP-A-6-132041 can be employed as a practical thermocompression bonding method.

Incidentally, the ground terminal 3 is configured so that each of the crimping force and the thermocompression bonding force is set to be weaker than the fixing force. Incidentally, the "crimping force" means a force by which the electric wire 7 is crimped with the electric wire crimping claws 38 and 39 by the ground terminal 3. Further, the "thermocompression bonding force" means a force by which the electric wire 7 is thermocompression-bonded to the thermocompression-bonding surface 32 of the ground terminal 3. Additionally, the "fixing force" means a force by which the ground terminal 3 is fixed to the vehicle body panel 2 by bolt-fastening.

The mounting structure 1 has the aforementioned configuration. Thus, at the disassembling of a vehicle or at the replacement of the electric wire 7, the electric wire 7 is detached from the vehicle body panel 2 according to the following procedure.

First, the coating portion 7*a* of the electric wire 7 is bent nearly at right angles. Additionally, the electric wire 7 is peeled off in a direction (i.e., a direction designated by arrow A shown in FIG. 1) perpendicular to the thermocompression bonding surface 32 of the ground terminal 3.

Then, simultaneously with the application of a force, which acts in the direction of arrow A, to one of the electric crimping claws 38 in the ground terminal 3, an opposite force acts on the fastening portion 33. At that time, as described above, the crimping force is weaker than the fixing force. Thus, the electric wire crimping claw 38 is unfolded. The electric wire 7 is released therefrom. Further, because the electric wire crimping claw 38 is positioned in the vicinity of the vehicle body mounting hole 34, the ground terminal 3 can be suppressed from being lifted as an operation of pulling the electric wire 7 in the direction of arrow A is performed when the electric wire 38 is unfolded by performing such an operation. Additionally, because the terminal body 31 is stiffened by the flanges 36 and 37, the terminal body 31 does not sag when the electric wire 7 is pulled. Consequently, a load can efficiently be applied to the electric wire 7 without lifting the ground terminal 3.

Subsequently, simultaneously with the application of a force, which acts in the direction of arrow A, to the other electric crimping claws 39 in the ground terminal 3, an opposite force acts on the fastening portion 33. At that time, as described above, the crimping force is weaker than the fixing force. Thus, the electric wire crimping claw 39 is unfolded. The electric wire 7 is released therefrom. Further, because the electric wire crimping claw 39 is positioned in the vicinity of the vehicle body mounting hole 34, the ground terminal 3 can be suppressed from being lifted as an operation of pulling the electric wire 7 in the direction of arrow A is performed when the electric wire 38 is unfolded by performing such an operation. Additionally, because the terminal body 31 is stiffened by the flanges 36 and 37, the terminal body 31 does not sag when the electric wire 7 is pulled. Consequently, a load can efficiently be applied to the electric wire 7 without lifting the ground terminal 3.

Incidentally, the electric wire crimping claws 38 and 39 are apart from each other in the electric wire arrangement direction by the non-interactive distance. Thus, the electric wire 7 can easily be peeled off for the following reason. In a case where the electric wire crimping claws 38 and 39 are provided in parallel with each other so that the electric wire crimping claws 38 and 39 are not apart from each other in the electric wire arrangement direction by the non-interactive distance, the crimping forces due to the electric wire crimping claws 38 and 39 overlap with each other at one peak (i.e., P1, as viewed in FIG. 15A), as illustrated in FIG. 15A. Thus, the peak level of the synthesized crimping force increases. Consequently, difficulties are associated with the peeling of the electric wire 7 from the ground terminal. Conversely, in a case where the electric wire crimping claws 38 and 39 are provided in parallel with each other so that the electric wire crimping claws 38 and 39 are apart from each other in the electric wire arrangement direction by the non-interactive distance, a distributed crimping force, which is synthesized from the crimping forces due to the electric wire crimping claws 38 and 39, has two peaks (i.e., P2 and P3, as illustrated in FIG. 15B). Thus, the peak level of the synthesized crimping force decreases. Consequently, the electric wire 7 can easily be peeled off.

Thus, when the two electric wire crimping claws 38 and 39 are unfolded, so that the electric wire 7 is released, a pulling force acting in the direction of arrow A is applied to the thermocompression bonding portion 7*b* of the electric wire 7 this time. Then, simultaneously with the application of the force acting in the direction of arrow A to the ground terminal 3 when pulled by the electric wire 7, an opposite force acts upon the vehicle body fixing claw 35. At that time, because the thermocompression bonding force is weaker than the fixing force, as described above, the thermocompression bonding portion 7*b* is peeled off from the ground terminal 3. The vehicle body fixing claw 35 remains engaged with the terminal engaging hole 23 of the vehicle body panel 2. Additionally, the thermocompression bonding portion 7*b* of the electric wire 7 is thermocompression-bonded only to the ridge 32*a* instead of the entire surface of the thermocompression bonding surface 32 of the ground terminal 3. The area of the compression bonded part decreases, so that a peeling-off operation is facilitated.

Incidentally, the thermocompression bonding portion 7*b* is pulled in the direction of arrow A, that is, a direction perpendicular to the thermocompression bonding surface 32 of the ground terminal 3. Thus, the thermocompression bonding portion 7*b* can be peeled off by a force weaker than a force used in the case of pulling the thermocompression bonding portion 7*b* in the direction of arrow B, that is, a direction parallel to the thermocompression bonding surface 32.

Also, as described above, the ground terminal 3 is configured so that the fastening portion 33 is placed lower than the terminal body 31 by a predetermined height H1. Thus, as illustrated in FIG. 13, the terminal body 31 is lifted from the vehicle body panel 2 by the height H1. Consequently, even in a case where minute projections are formed on the vehicle body panel 2 and where a step-like portion is present in the vicinity of the ground terminal 3 due to the connection between the vehicle body panel 2 and another vehicle body panel 2, the ground terminal 3 can easily be assembled thereto. Even in a case where tape is wound around the ground terminal 3 for waterproof purpose, the ground terminal 3 can easily be assembled thereto.

Then, an operation of detaching the electric wire 7 is finished.

Other Embodiments

Although it has been described in the foregoing description of the above-described embodiments the case where when the electric wire 7 is detached from the vehicle body panel 2, the electric wire 7 is peeled off in a direction perpendicular to the thermocompression bonding surface 32 of the ground terminal 3, it is sufficient to pull the electric wire 7 in a direction intersecting with the thermocompression bonding surface 32. It is unnecessary that the direction, in which the electric wire 7 is pulled, does not necessarily intersect with the thermocompression surface 32 of the ground terminal 3 at 90°.

Although it has been described in the foregoing description of the above-described embodiments the case where the electric wire 7 is attached to the ground terminal 3 by thermocompression-bonding and crimping, the electric wire 7 can be attached thereto either only by the thermocompression-bonding or only by crimping.

Although it has been described in the foregoing description of the above-described embodiments the case where the ground terminal 3 is fixed to the vehicle body panel 2, the invention can be applied to a mount member (e.g., a casing for an electronic unit) other than the vehicle body panel 2. In this case, the fixing force means a force by which the ground terminal 3 is fixed to the mount member by bolt-fastening.

Although the ground terminal 3 having the annular fastening portion 33 has been described in the foregoing description of the above-described embodiments, the invention can be applied to fastening portions 33 of the hook type and the fork type. Additionally, the invention can be applied to connecting terminals (e.g., those fastened by forcible-fitting or press-fitting) other than such a ground terminal 3. In this case, the "crimping force" means a force by which the electric wire 7 is crimped to the connecting terminal. Further, the "thermocompression bonding force" means a force with which the electric wire 7 is thermocompression-bonded to the connecting terminal. Moreover, the "fixing force" means a force by which the connecting terminal is fixed to the vehicle body panel 2.

Although the mounting structure 1 for mounting the electric wire 7 has been described in the foregoing description of the above-described embodiments, the invention can be applied to linear elements (e.g., FFC (flexible flat cable), a flat electric cable, and various electric cables) other than the electric wire 7. In this case, the "crimping force" means a force of crimping the linear element with the electric wire crimping claws 38, 39 by the ground terminal 3.

The invention can be applied widely to various industrial fields such as automobile, aircraft, electric train, manufacturing-plant, electric appliance, and OA equipment.

What is claimed is:

1. A mounting structure comprising:

a connecting terminal;

a mount member to which the connecting terminal is mounted; and a linear element attached to said connecting terminal, wherein said connecting terminal has a mount member mounting hole and at least one linear element crimping claw;

wherein said connecting terminal further has a thermocompression bonding surface on which one end of said linear element is bonded by thermocompression to attach said linear element to said connecting terminal, said mount member mounting hole is placed in a vicinity of said linear element crimping claw beside an arrangement line of said linear element, wherein said connecting terminal has a fastening portion placed in rear of said linear element crimping claw, wherein said mounting structure has a pair of said linear element crimping claws; and said pair of said linear element crimping claws are apart from each other by a predetermined non-interactive distance, said mounting structure further has a first flange which is erected on an opposing side to said mount member mounting hole interposing said linear element and which extends in an arrangement direction of said linear element, and a side wall of said first flange guides said linear element.

2. A mounting structure comprising:

a connecting terminal;

a mount member to which the connecting terminal is mounted; and a linear element attached to said connecting terminal, wherein said connecting terminal has a mount member mounting hole and a thermocompression bonding surface on which one end of said linear element is bonded by thermocompression to attach said linear element to said connecting terminal;

said mount member mounting hole is placed in a vicinity of said thermocompression bonding surface beside an arrangement line of said linear element, wherein said connecting terminal has a first flange stiffening a terminal body which is erected on an opposite side to said mount member mounting hole interposing said linear element so as to extend in an arrangement direction of said linear element, and a side wall of said first flange guides said linear element.

3. The mounting structure according to claim 2, further comprising a second flange which curves toward said fastening portion from said terminal body.

4. The mounting structure according to claim 3, wherein said first and second flanges extend perpendicular to said connecting terminal.

* * * * *